US006725700B2

(12) United States Patent
Yogo

(10) Patent No.: US 6,725,700 B2
(45) Date of Patent: Apr. 27, 2004

(54) BENDING DEVICE AND CONTROL METHOD THEREOF

(75) Inventor: Teruaki Yogo, Seto (JP)

(73) Assignee: Kabushiki Kaisha Opton, Seto (JP)

( * ) Notice: Subject to any disclaimer, the term of this patent is extended or adjusted under 35 U.S.C. 154(b) by 0 days.

(21) Appl. No.: 10/213,884

(22) Filed: Aug. 6, 2002

(65) Prior Publication Data

US 2003/0029213 A1 Feb. 13, 2003

(30) Foreign Application Priority Data

Aug. 8, 2001 (JP) ..... 2001-240615

(51) Int. Cl.[7] ..... B21D 7/08
(52) U.S. Cl. ..... 72/173; 72/166; 72/307
(58) Field of Search ..... 72/173, 174, 166, 72/307, 387, 388, 319

(56) References Cited

U.S. PATENT DOCUMENTS 3,690,278 A * 9/1972 Rautavalta ..... 29/243.519
3,952,572 A 4/1976 Mergler et al. ..... 72/298
4,047,418 A * 9/1977 Fangmeier et al. ..... 72/278
5,862,698 A * 1/1999 Yogo ..... 72/173
6,662,613 B2 * 12/2003 Ichiryu et al. ..... 72/173
2002/0170329 A1 * 11/2002 Ichiryu et al. ..... 72/166

FOREIGN PATENT DOCUMENTS

| | | |
|---|---|---|
| DE | 199 56 796 A1 | 6/2001 |
| JP | 01-154824 | 6/1989 |
| JP | 04197528 | 7/1992 |
| JP | 09103825 | 4/1997 |

* cited by examiner

*Primary Examiner*—Daniel C. Crane
(74) *Attorney, Agent, or Firm*—Davis & Bujold, PLLC

(57) ABSTRACT

The bending device 25 comprises a positioning jig 10 having a clearance opening 8 formed therein for passing an elongate material 1, fixed to a device body, and a movable bending jig 28 having a clearance opening 30 formed therein for passing the material 1, provided at a position to which the material 1 is supplied from the positioning jig 10. The bending jig 28 is attached to a dome portion 26 which is part of a rotating member 24 rotated along a spherical surface having the center on the material 1 passing through the positioning jig 10. As the rotating member 24 rotates along the spherical surface, the bending jig 28 moves along the spherical surface. As a result, the material 1 is bent by being supplied with its supply direction changed from the positioning jig 10.

9 Claims, 7 Drawing Sheets

BENDING DEVICE AND CONTROL METHOD THEREOF

FIELD OF THE INVENTION

This invention relates to a bending device, and a control method thereof, for bending an elongate material by moving a bending jig having a clearance opening formed therein for passing the elongate material.

BACKGROUND OF THE INVENTION

A heretofore known bending device, as disclosed in the Unexamined Japanese Patent Publication No. 1-154824, supplies an elongate material in the axial direction of the material, and comprises a positioning jig having a clearance opening formed therein for passing the elongate material, fixed to a device body, and a bending jig arranged at a position to which the material is supplied from the positioning jig. In this bending device, the bending jig is supported to move linearly to both vertical and horizontal directions orthogonal to the longitudinal direction of material, and the material is bent into a required shape by being moved on a plane orthogonal to the longitudinal direction of material.

However, such a conventional bending device necessitates, for example, a vertical motion mechanism provided with a pair of guide rails for supporting the bending jig slidably to the vertical direction, and a horizontal motion mechanism provided with a pair of guide rails for supporting the vertical motion mechanism slidably to the horizontal direction. Consequently, a constitution of the bending device has been complex and the device itself has been large.

SUMMARY OF THE INVENTION

An object of the present invention is to provide a bending device, and a control method thereof, which is simply organized and can bend the material by moving a bending jig having a clearance opening formed therein for passing an elongate material.

To attain this and other objects, the present invention provides a bending device comprising a positioning jig, a bending jig and a rotating member. The positioning jig has a clearance opening formed therein for passing an elongate material, and is fixed to a device body. The bending jig also has a clearance opening formed therein for passing the elongate material, and is arranged at a position to which the material is supplied from the positioning jig. The rotating member allows the bending jig to rotate on and along a spherical surface having the center on the material passing through the positioning jig.

According to such a constitution, since the bending jig moves on and along the spherical surface, the material passed from the positioning jig is supplied to the bending jig with its supply direction changed, and then bending is performed. As a result, there is no need to provide a vertical motion mechanism having a pair of guide rails for supporting the bending jig slidably to the vertical direction and a horizontal motion mechanism having a pair of guide rails for supporting the vertical motion mechanism slidably to the horizontal direction. Accordingly, a simple constitution of the bending device is made possible and a compact bending device is realized.

It is advantageous if part of the rotating member is formed into a spherical shell which is held slidably between a pair of spherical convex and concave members both fixed to the device body, and the positioning jig is attached to the spherical convex member.

It is also advantageous if the rotating member is rotated by means of at least three linear drive mechanisms. Drive mechanisms using servo motors or hydraulic cylinders can be adopted as the linear drive mechanisms.

Moreover, it is advantageous, if a portion of the spherical convex and concave members is cut off.

The bending device constituted as such can prevent the bent material passed from the bending jig from interfering with the rotating member and the spherical convex and concave members.

BRIEF DESCRIPTION OF THE DRAWING FIGURES

The invention will now be described, by way of example, with reference to the accompanying drawings, in which.

DETAILED DESCRIPTION OF THE INVENTION

Figure 1:
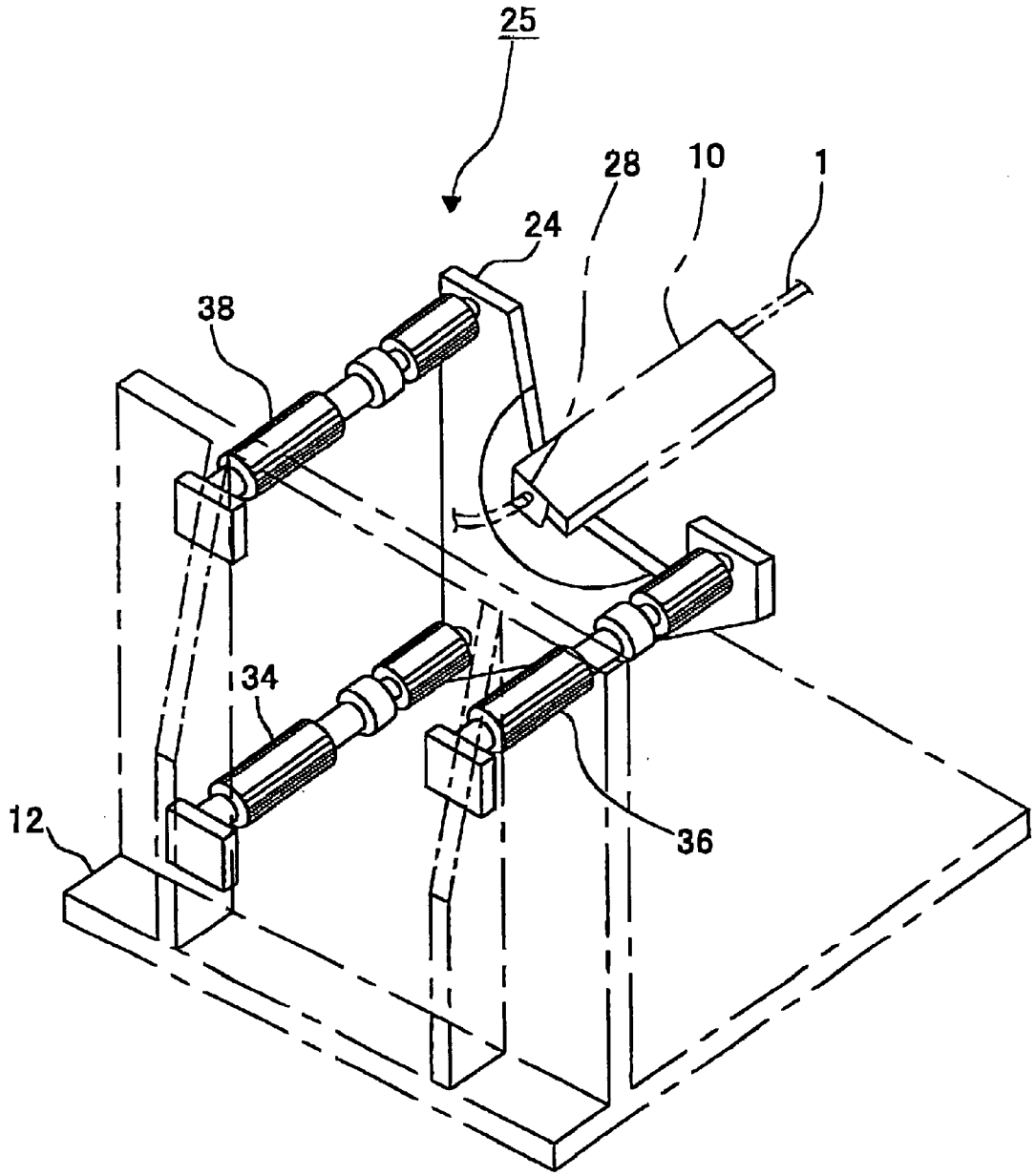
FIG. 1 is a perspective view of a relevant part of a bending device according to an embodiment of the present invention.

A bending device 25 shown in FIG. 1 mainly comprises linear drive mechanisms 34, 36, 38, a rotating member 24, and a bending jig 28. One end of each linear drive mechanism 34, 36, 38 is fixed to a device frame 12, and the other end of the same is coupled with the rotating member 24. The bending jig 28 is attached to the rotating member 24.

Figure 2:
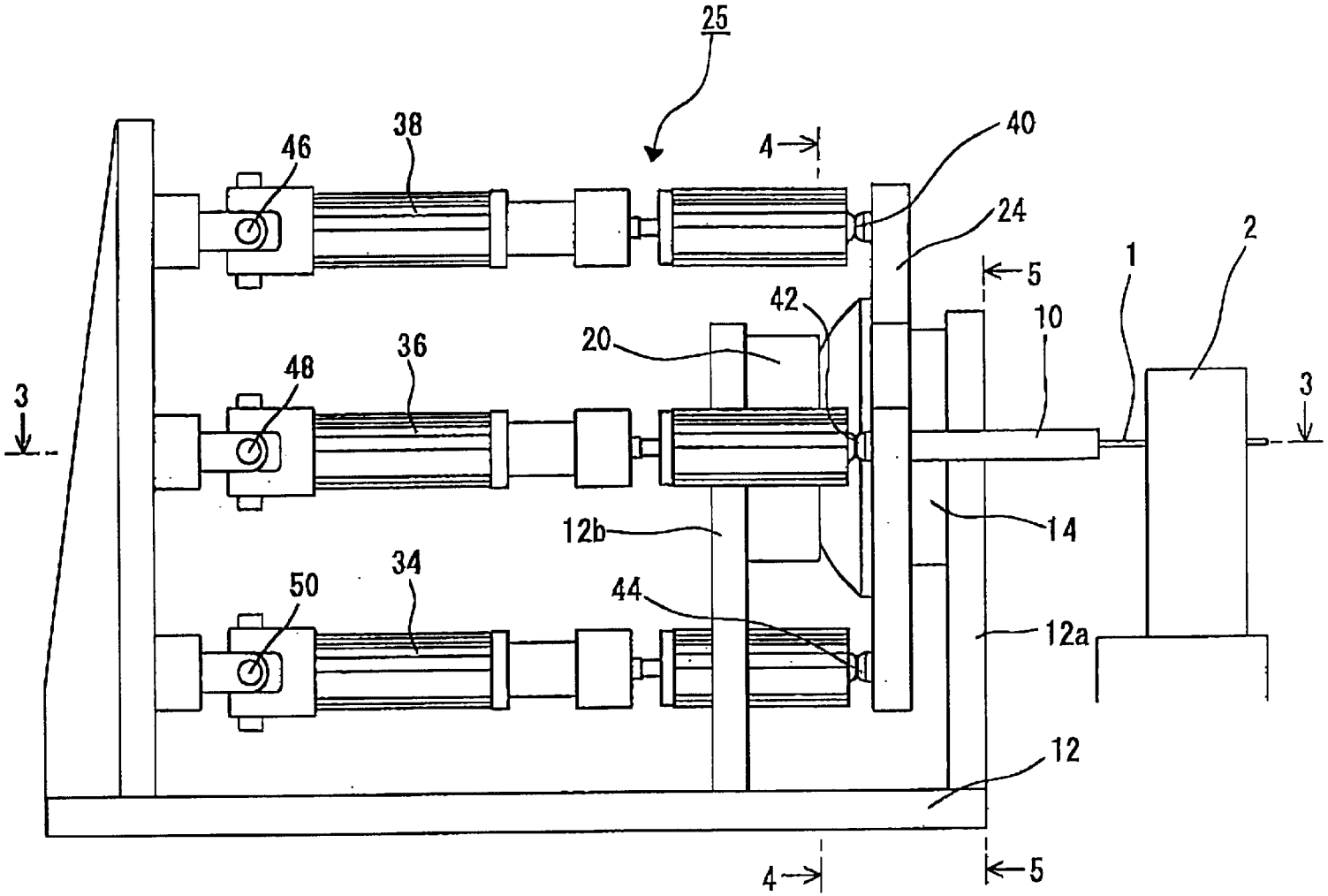
FIG. 2 is a front view of the bending device of the embodiment.
Figure 3:
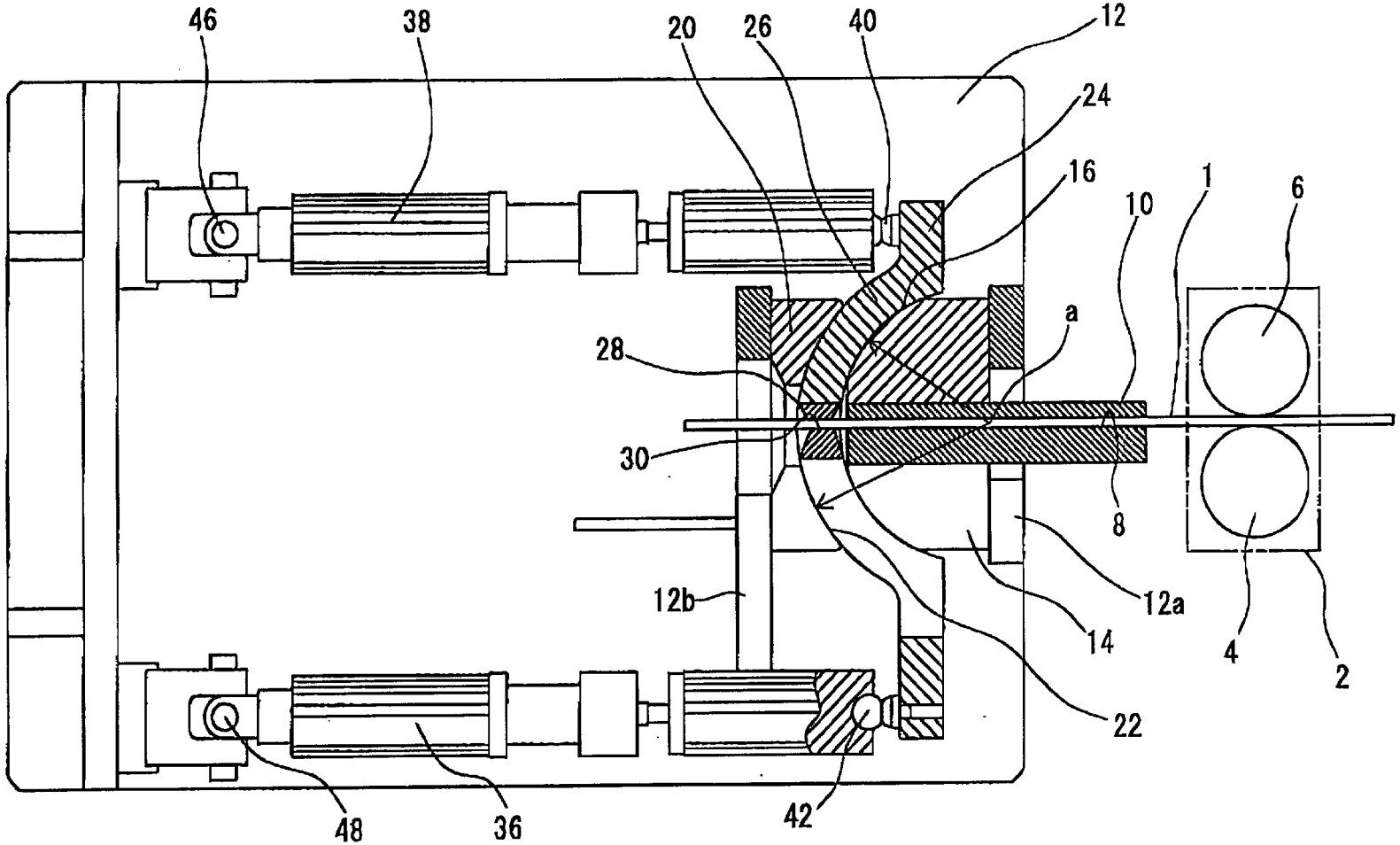
FIG. 3 is a partial sectional view taken along the line 3—3 in FIG. 2.

Referring to FIGS. 2 and 3, a constitution of the bending device 25 is explained according to a process flow of a material 1. The material 1 is an elongate material and, for example, made of titanium alloy. The material 1 is coiled around a not shown bobbin. After the material 1, reeled out from the bobbin, is straightened, it passes between a pair of rollers 4, 6 provided on a drive mechanism 2 to be supplied in the axial direction of the material 1.

At a position to which the material is supplied, a positioning jig 10 having a clearance opening formed therein for guiding and passing the material 1 is provided. The positioning jig 10 is attached to a spherical convex member 14. The spherical convex member 14 is fixed to a stay 12*a* which is fixed to the device frame 12.

The spherical convex member 14 has a spherical surface 16 formed therein, which is convex in the supply direction of the material 1. The spherical convex member 14 is arranged so that the center "a" of the spherical surface 16 is located on the axis of the material 1 passing through the positioning jig 10.

Figure 5:
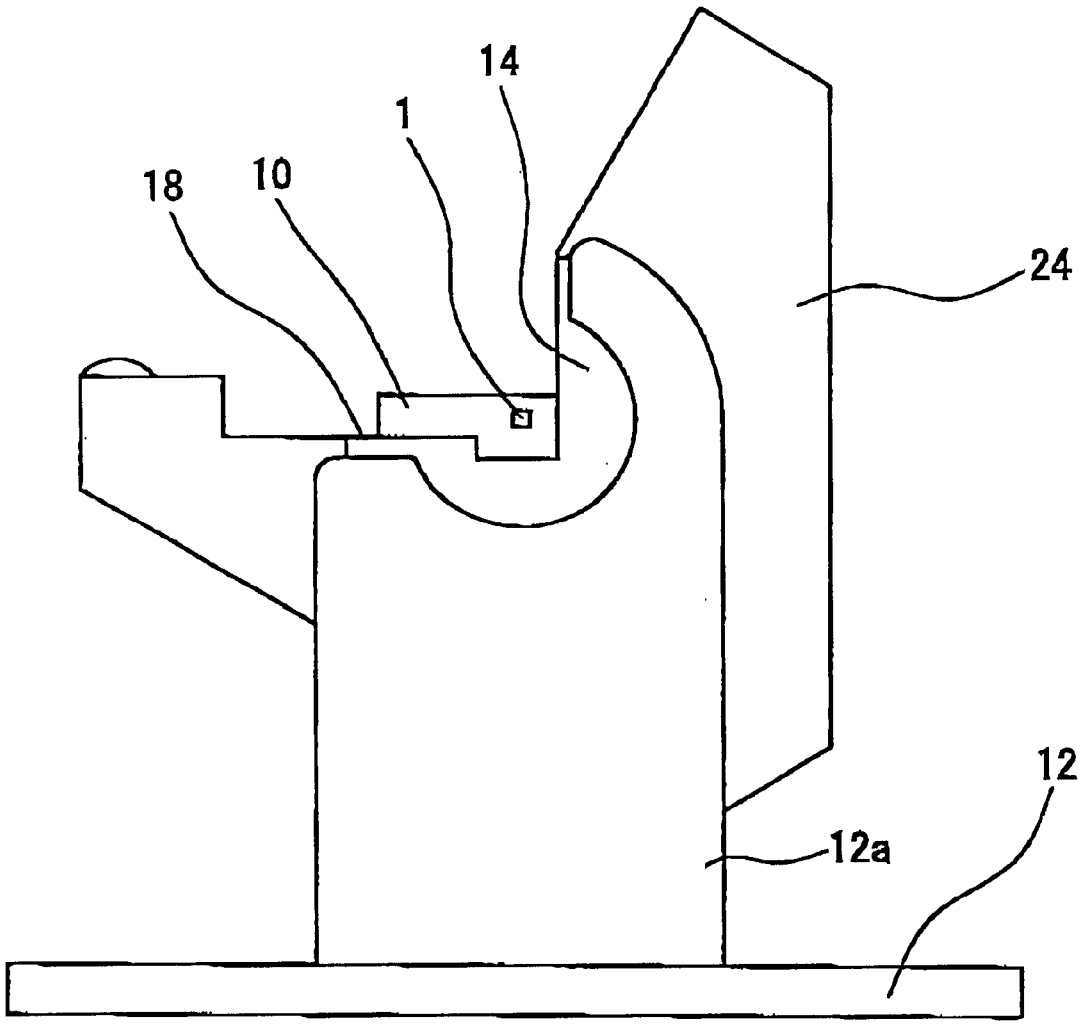
FIG. 5 is a side view seen from a cross section taken along the line 5—5 in FIG. 2.

As shown in FIGS. 3 and 5, about one fourth of the spherical convex member 14 is cut off to form a cut off area 18. The positioning jig 10 is attached to this cut off area 18.

Ahead of the spherical convex member 14, in the direction to which the material 1 is supplied, a spherical concave member 20 is fixed to a stay 12*b*, as shown in FIG. 3. The stay 12*b* is fixed to the device frame 12. On a surface of the spherical concave member 20, opposite to the spherical surface 16 of the spherical convex member 14, a convex spherical surface 22 is formed. The spherical surface 22 is concentric to the spherical surface 16 and has the common center "a", as can be seen in FIG. 3. About one fourth of the spherical concave member 20 is also cut off just like the spherical convex member 14.

Between the convex spherical surface 16 of the spherical convex member 14 and the concave spherical surface 22 of the spherical concave member 20, a dome portion 26 which constitutes part of the rotating member 24 is held. The dome portion 26 is formed into a spherical shell having a certain thickness. A convex surface of the spherical shell-like dome portion 26 is concentric to the spherical surface 22, while a concave surface of the spherical shell-like dome portion 26 is concentric to the spherical surface 16. Accordingly, it is possible for the dome portion 26 to slide between the concave spherical surface 22 of the spherical concave member 20 and the convex spherical surface 16 of the spherical convex member 14.

The bending jig 28 is attached to a cut off area 32 of the dome portion 26. The bending jig 28 has a clearance opening 30 formed therein for passing the material 1.

On a circumference of a circle concentric with the axis of the material 1, the three linear drive mechanisms 34, 36, 38 are arranged at an evenly spaced angle to be parallel to the axial direction of the material 1.

The three linear drive mechanisms 34, 36, 38 are expandable and contractable. They can be, for example, drive mechanisms using hydraulic cylinders or servo motors.

One end of each linear drive mechanism 34, 36, 38 is coupled with the rotating member 24 via a ball joint 40, 42, 44, respectively, while the other end of the same is coupled with the device frame 12 via a universal joint 46, 48, 50, respectively. The linear drive mechanisms 34, 36, 38 are expanded and contracted to a direction approximately parallel to a moving direction of the material 1.

Now, an operation of the bending device 25 of the present embodiment is described.

A pair of rollers 4, 6 of the drive mechanism 2 are driven, and the material 1 is supplied from the drive mechanism 2 in the axial direction of the material 1. As a result, the material 1 passes through the clearance opening 8 of the positioning jig 10 then the clearance opening 30 of the bending jig 28.

In order to bend the material 1 into a required shape, the linear drive mechanisms 34, 36, 38 are separately controlled for expansion or contraction, respectively, to rotate the rotating member 24. By rotation of the rotating member 24, the bending jig 28 is freely moved along the spherical surfaces 16, 22 having the common center "a." In short, while the positioning jig 10 is fixed to the device frame 12, the bending jig 28 is moved along the spherical surfaces 16, 22, and the material 1 is supplied to be bent to the bending jig 28 with its supply direction changed.

Figure 4:
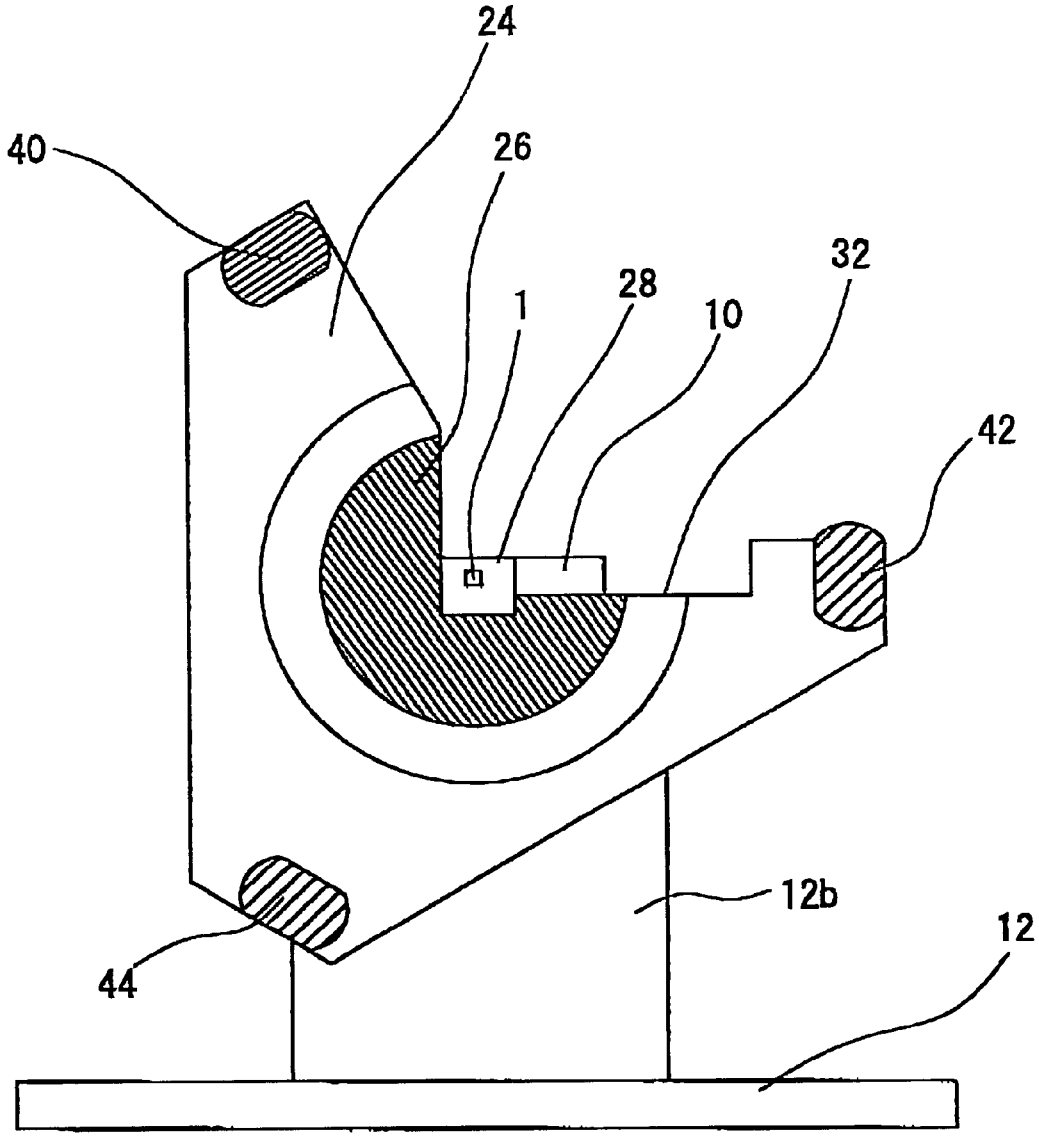
FIG. 4 is a partial sectional view taken along the line 4—4 in FIG. 2.

Since the bending jig 28 can be moved freely to any direction along the spherical surfaces 16, 22, it is possible to bend the material 1 into a required shape. In addition, since the cut off area 32 of the dome portion 26, a cut off area of the spherical concave member 20 and the cut off area 18 of the spherical convex member 14 completely overlap with each other when looked from the axial direction of the material 1, as shown in FIGS. 4 and 5, interference with the dome portion 26, spherical concave member 20 and spherical convex member 14 can be prevented when the bent material 1 is passed from the bending jig 28.

Hereinafter, a control method of the bending device according to the present embodiment is described by way of FIGS. 6 and 7.

Figure 6:
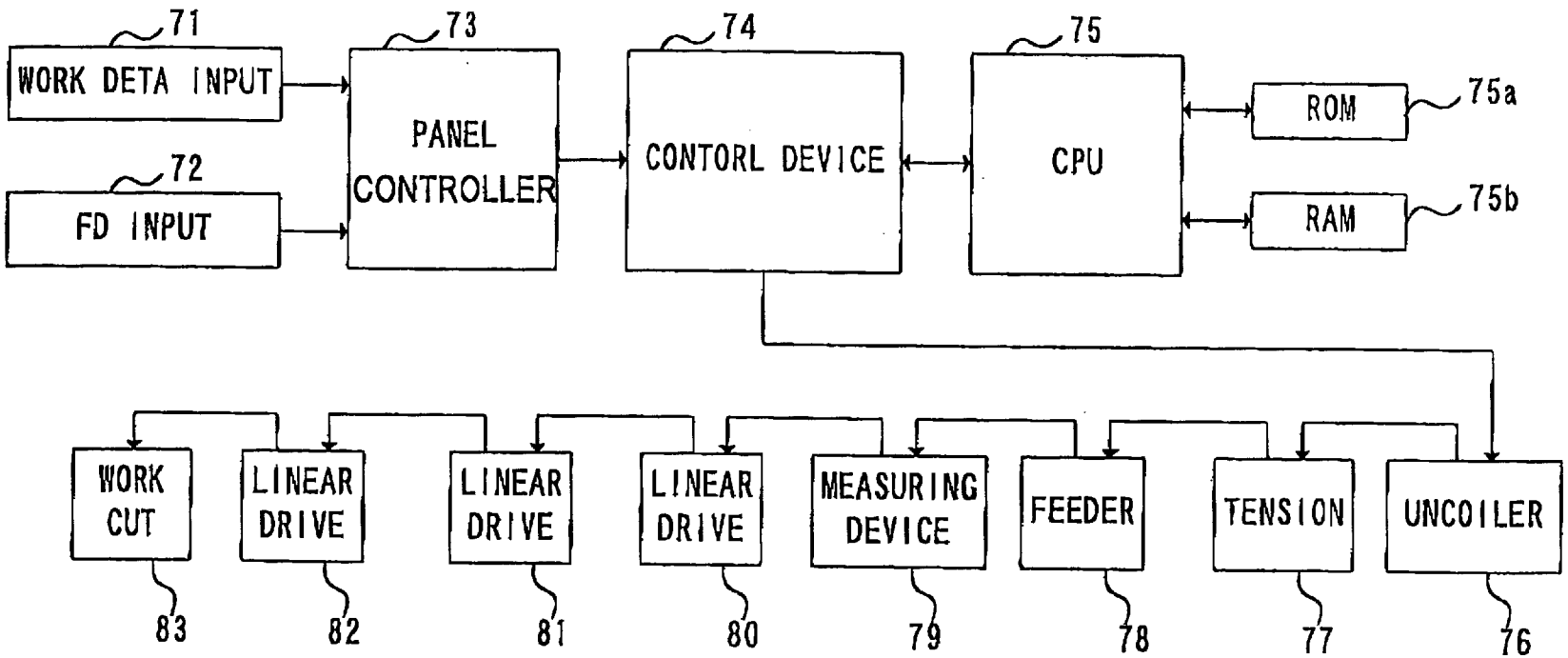
FIG. 6 is a block diagram showing a functional constitution of the bending device of the embodiment.

FIG. 6 is a block diagram showing a functional constitution of the bending device of the present embodiment. In FIG. 6, types of the material 1 and the bending jig 28, etc. are selected to create a work data input 71 or a FD input 72. Here, FD denotes, for example, an external memory such as a floppy disk. The work data input 71 or FD input 72 is inputted to a panel controller 73. An output from the panel controller 73 is inputted to a control device 74. In a CPU 75 connected to the control device 74, necessary calculation is performed using, if required, an external memory 75*a*, ROM 75*b* and RAM 75*c*. A result of the calculation in the CPU 75 is again inputted to the control device 74. An output from the control device 74 is transmitted to an uncoiler 76 and the following operational portions as a command value. More particularly, the material 1 is reeled out from a bobbin by means of the uncoiler 76, and is straightened and stretched at a predetermined speed by means of a tension 77, to be supplied to the drive mechanism 2. The material 1 supplied from the drive mechanism 2 at a predetermined speed by means of a feeder 78 is measured by a measuring device 79 (encoder) and passed to the positioning jig 10. Then, three linear drive mechanisms, that is, linear drive mechanisms 80, 81 and 82, are expanded or contracted, to complete required bending. Lastly, the bent material 1 is cut up into respective product units in a work cut 83.

Figure 7:
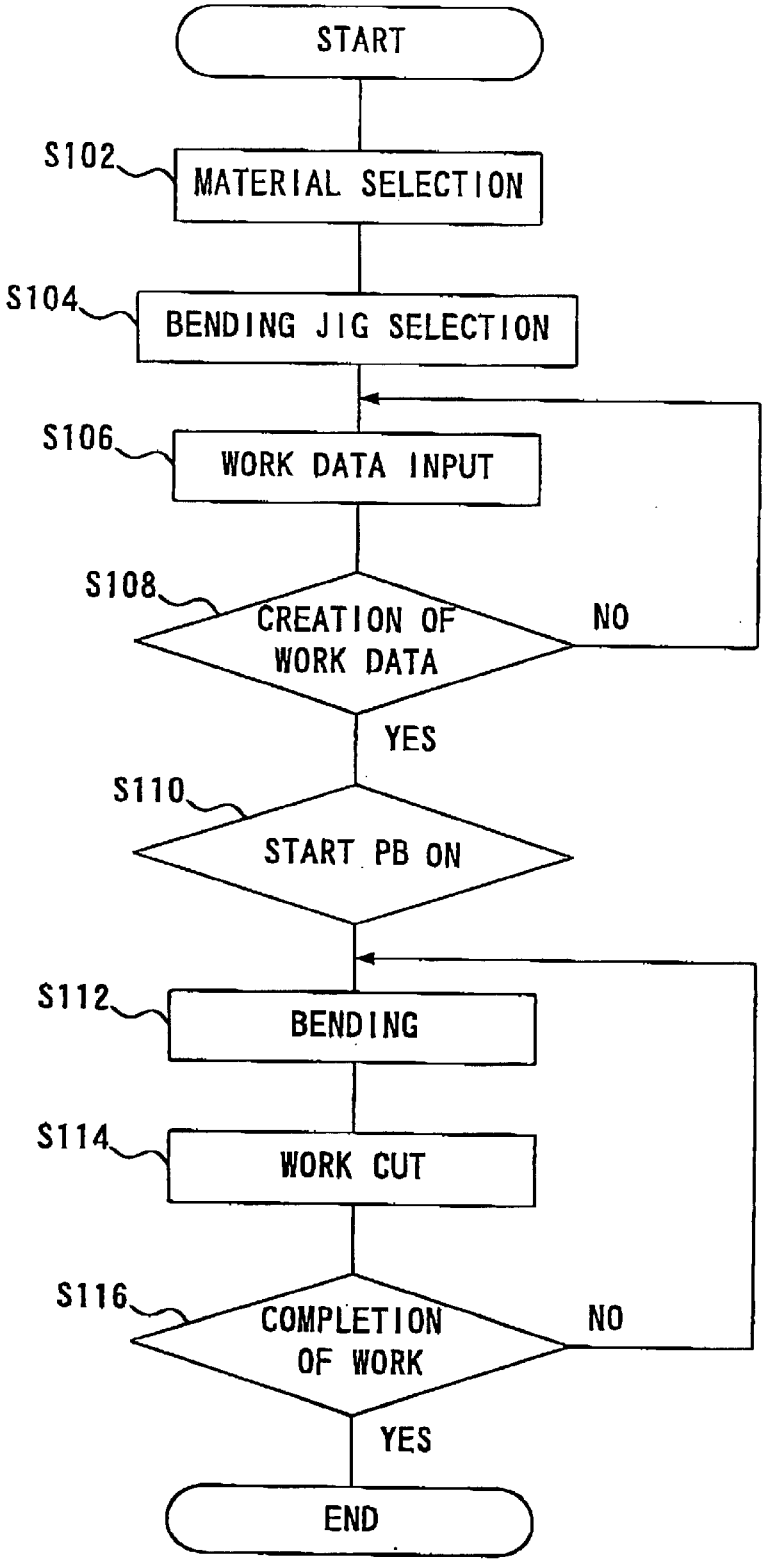
FIG. 7 is a flowchart illustrating a control method of the bending device of the embodiment.

FIG. 7 shows a control method of the bending device by means of a flowchart.

At first, a selection of a material is performed (S102) and then a selection of a bending jig is performed (S104). Results of the selections are inputted as a work data input (S106) to create work data (S108). If the work data input is incomplete, a process returns to the work data input (S106) till a correct work data input is made. When creation of the work data is complete, a start switch is turned on (S110) and bending is performed (S112). When the bending is complete, the bent work piece is cut up into respective product units in the work cut (S114), and the process ends (S116). Steps from bending (S112) to the work cut (S114) are repeated until the number of bending inputted upon the work data input is completed.

As described in the above, the bending device of the present invention has a simple mechanical structure which enables the bending jig to move along the spherical surface, and can freely bend the material at any direction An embodiment of the present invention has been described, but the present invention is not limited to the above embodiment, and other modifications and variations are possible within the scope of the present invention.

For instance, three linear drive mechanisms are provided in the present embodiment. However, four or more linear drive mechanisms will enable bending by which further complicated shapes are attained Additionally, in the present embodiment, the linear drive mechanisms are arranged parallel to the axial direction of the material. However, they do not necessarily have to be so.

What is claimed is:

1. A bending device comprising:

a positioning jig having a clearance opening formed therein for receiving an elongate material, and the positioning jig being fixed to a device body;

a bending jig having a clearance opening formed therein for receiving the elongate material, and the bending jig being arranged at a position for receiving the elongate material supplied from the positioning jig; and a rotating member for rotating the bending jig on and along a spherical surface having a center coincident with the elongate material as the elongate material passes through the positioning jig;

wherein part of the rotating member is formed into a spherical shell and slidably held between a pair of spherical convex and concave members fixed to the device body.

2. The bending device according to claim 1, wherein the positioning jig is attached to the spherical convex member.

3. The bending device as set froth in claim 1, wherein a portion of the rotating member is one of cut off or removed.

4. The bending device according to claim 3, wherein a portion of the spherical convex member and a portion of the spherical concave member is one of cut off or removed.

5. A bending device comprising:

a positioning jig having a clearance opening formed therein for receiving an elongate material, and the positioning jig being fixed to a device body;

a bending jig having a clearance opening formed therein for receiving the elongate material, and the bending jig being arranged at a position for receiving the elongate material supplied from the positioning jig; and a rotating member for rotating the bending jig on and along a spherical surface having a center coincident with the elongate material as the elongate material passes through the positioning jig;

wherein the rotating member is rotated by at least three linear drive mechanisms.

6. The bending device according to claim 5, wherein the at least three linear drive mechanisms are each a drive mechanism using one of a hydraulic cylinder or a servo motor.

7. The bending device according to claim 5, wherein a portion of the rotating member is one of cut off or removed.

8. The bending device according to claim 5, wherein a portion of the spherical convex member and a portion of the spherical concave member is one of cut off or removed.

9. A control method of a bending device which includes:

a positioning jig having a clearance opening formed therein for receiving an elongate material, and the positioning jig being fixed to a device body;

a bending jig having a clearance opening formed therein for receiving the elongate material, and the bending jig being arranged at a position for receiving the elongate material supplied from the positioning jig; and a rotating member for rotating the bending jig on and along a spherical surface having a center coincident with a center of the elongate material as the elongate material passes through the positioning jig, wherein part of the rotating member is formed into a spherical shell and slidably held between a pair of spherical convex and concave members fixed to the device body;

the method comprising the step of bending the elongate material, as the elongate material is supplied from the positioning jig to the bending jig, by moving the bending jig along the spherical surface and rotating the bending jig about the center.

* * * * *